United States Patent [19]

Gaub

[11] Patent Number: 4,463,507

[45] Date of Patent: Aug. 7, 1984

[54] GRADER BLADE ATTACHMENT

[76] Inventor: Arnold A. Gaub, Box 18, Alpine, Wyo.

[21] Appl. No.: 367,275

[22] Filed: Apr. 12, 1982

[51] Int. Cl.[3] ..... E02F 3/76

[52] U.S. Cl. ..... 37/117.5; 37/DIG. 12; 172/820; 172/832; 414/724

[58] Field of Search ..... 37/117.5, 221, DIG. 3, 37/266, DIG. 12, 241; 172/273, 274, 817, 820, 832; 414/722, 724

[56] References Cited

U.S. PATENT DOCUMENTS

| | | | |
|---|---|---|---|
| 2,488,695 | 11/1949 | Upton | 37/117.5 |
| 2,644,251 | 7/1953 | Smith | 37/117.5 |
| 2,986,826 | 6/1961 | Timmons | 37/117.5 |
| 3,181,256 | 5/1965 | Discenza | 37/117.5 |
| 3,230,645 | 1/1966 | Lutz | 37/117.5 X |
| 3,440,744 | 4/1969 | Smith | 37/117.5 |
| 3,469,330 | 9/1969 | Hood et al. | 37/117.5 |
| 3,665,622 | 5/1972 | Lamb | 37/117.5 |
| 3,913,720 | 10/1975 | Messner | 400/384 |
| 4,189,854 | 2/1980 | Haynes | 37/117.5 |
| 4,222,442 | 9/1980 | Westendorf et al. | 172/273 |
| 4,255,884 | 3/1981 | Williams | 37/117.5 |

FOREIGN PATENT DOCUMENTS

| | | | |
|---|---|---|---|
| 2249268 | 4/1974 | Fed. Rep. of Germany | 37/117.5 |

*Primary Examiner*—Edgar S. Burr
*Assistant Examiner*—Moshe I. Cohen
*Attorney, Agent, or Firm*—B. Deon Criddle

[57] ABSTRACT

A quickly attached and removed adjustable grader blade attachment for a bucket of a bucket vehicle, which includes a blade, and an adapter bracket and frame assembly that will permit the blade to be angularly adjusted by hydraulic or mechanical means and a bucket bottom engaging member that will serve as a cutting depth control for the grader attachment.

14 Claims, 5 Drawing Figures

GRADER BLADE ATTACHMENT

BACKGROUND OF THE INVENTION

1. Field of the Invention

Figure 1:
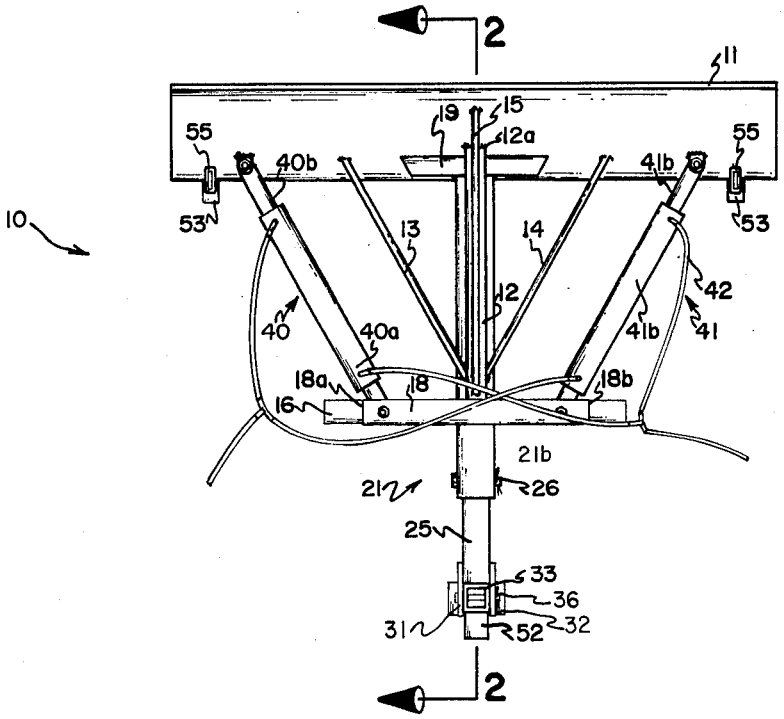

This invention pertains to the general field of earth moving equipment and in particular, to removably attached grader blade attachments that may be used in conjunction with the buckets commonly employed on front-end loaders, backhoes, and the like, to convert such vehicles into graders, snowplows or the like.

2. Description of Prior Art

There are many previously known grader attachments designed to enable a front-end loader, backhoe tractor or similar vehicle to be adapted to varying uses. Such prior art include U.S. Pat. Nos. 3,665,622 (Lamb); 2,488,695 (Upton); 4,255,884 (Williams); 2,986,826 (Timmons); 3,181,256 (Discenta); 3,469,330 (Hood); 4,189,854 (Haynes) and 2,644,251 (Smith).

Much of the prior art in the field of grader attachments consists of devices that are quite cumbersome to use, structurally complex and that necessarily require a great deal of time to install.

Some of the known grader blade attachment devices are intended to provide means that will avoid the necessity of having the vehicle driver dismount from the main vehicle installation and removal. Such a device is shown, for example, in U.S. Pat. No. 4,255,884 (Williams). However, in using the device disclosed in the Williams patent, care must be taken in driving the bucket vehicle and the device has many small fitting spaces in which ice and snow and other debris can accumulate and from which such debris must be removed before the grader attachment can be connected to a bucket of the vehicle.

The grader attachment devices known in the past, either have not provided for angulation of the blade with respect to the bucket on which it is mounted, to permit changing of the angle of attack of the vehicle when used as a grader, or have not provided for easy changing of such blade angle.

The present invention solves the difficulties common to the prior art by utilizing a grader attachment that is free standing, and with a blade that is easily angulated with respect to a support frame. In addition, the present invention does not have the close tolerance spaces that can be jammed by snow, dirt and other objects.

OBJECTS OF THE INVENTION

A principal object of the present invention is to provide a grader blade attachment adaptable to use with a wide variety of conventional earth-moving buckets commonly attached to front-end loaders, backhoes and similar equipment.

Other objects of the present invention are to provide a grader attachment that can be easily and quickly attached to a bucket vehicle and that can be selectively angled to push dirt, snow or the like.

Still another object of the present invention is to provide a grader blade attachment which is easy to maintain in proper working order.

Yet another object of the present invention is to provide a grader blade attachment that can be readily set to have a desired angle of attack, but that is rigid when attached to a bucket vehicle and wherein a member at the bottom of the bucket serves as a guide for the bottom of the blade.

PRINCIPAL FEATURES OF THE INVENTION

Principal features of the invention include a blade which may be used for snow removal, movement of dirt, and similar uses. The blade is articulatively connected to a support frame system including a bucket support bracket which receives the leading bottom edge of the bucket of a bucket vehicle.

The grader attachment support frame system is pivotable by hydraulic or mechanical means that connect to the bucket at its top and connect to the bucket bracket outboard of the leading edge of the bucket. The length of the main frame is adjustable by pin means to adapt to buckets of various types.

Other objects and features of the invention will become apparent from the following detailed description and drawing disclosing what is presently contemplated as being the best mode of the invention.

THE DRAWING

Figure 2:
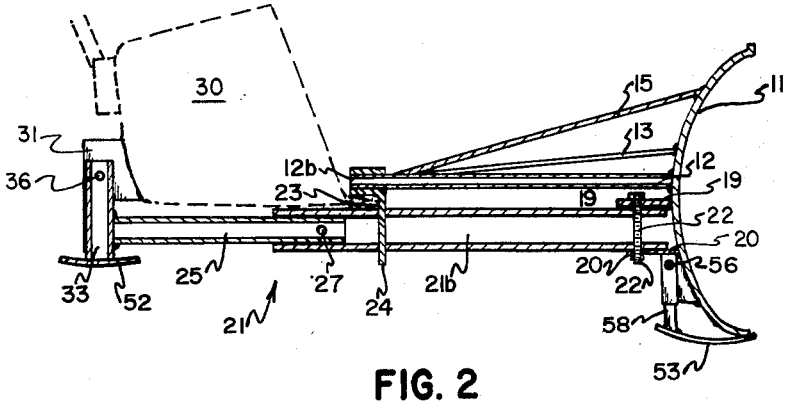
Figure 2A:
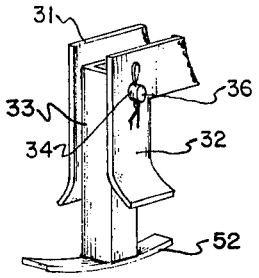
Figure 3:
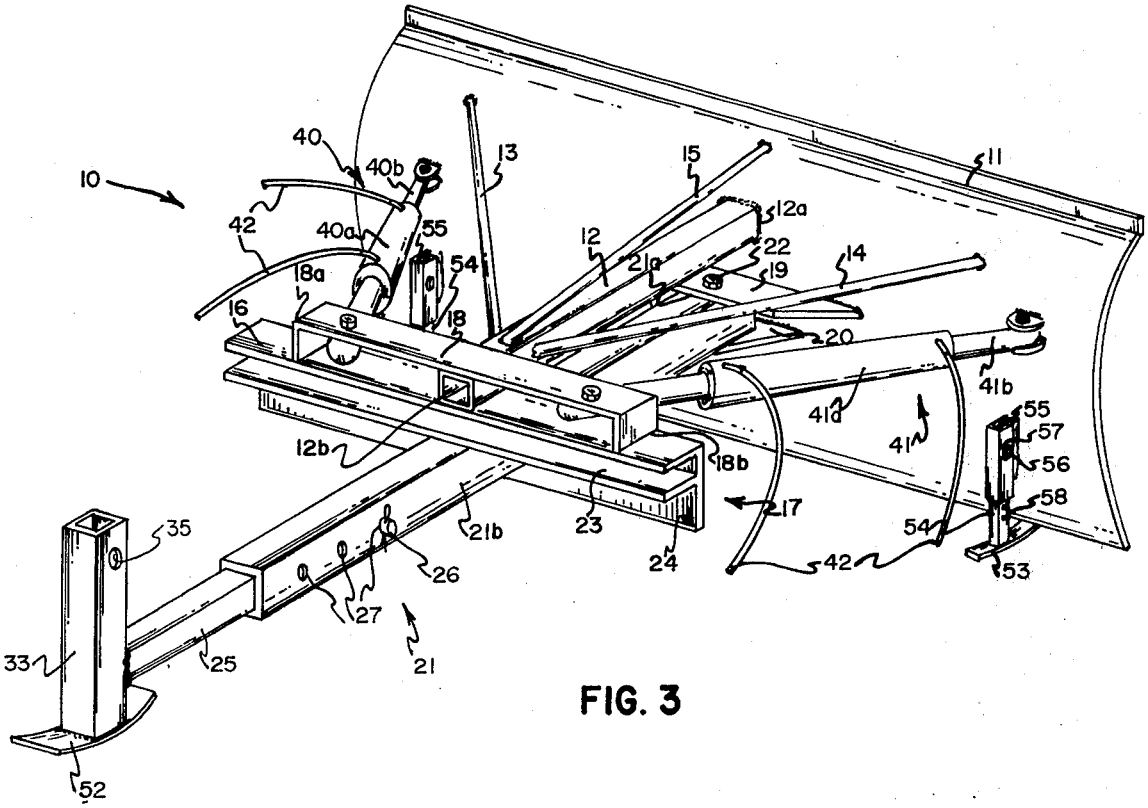

FIG. 1, is a top plan view of a preferred embodiment of the grader attachment of the invention;

FIG. 2, a sectional view of the attachment of the invention, taken on the line 2—2 of FIG. 1, and with a bucket shown fragmentarily;

FIG. 2*a*, an exploded and enlarged fragmentary perspective view of a portion of the invention taken;

FIG. 3, a perspective view of the grader blade attachment; and

Figure 4:
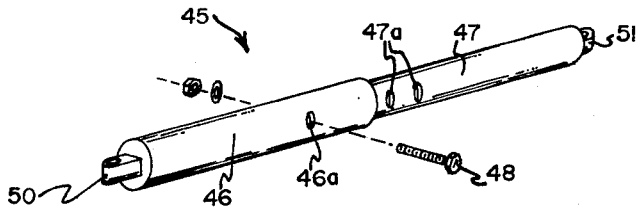

FIG. 4, a perspective view of a manually adjustable arm of the invention.

In the illustration of the preferred embodiment of the invention shown best in fully assembled form in FIG. 1, the grader blade attachment is shown generally at 10.

The grader blade attachment 10 includes the usual elongate curved scraper blade 11 having a pivot arm 12 projecting rearwardly therefrom. The pivot arm 12 has one end 12*a* fixed, by welding or the like, to the blade at the longitudinal center thereof and below the longitudinal centerline. Struts 13, 14, and 15 are each fixed to arm 12, intermediate its length and extend diagonally therefrom to be welded or otherwise attached to the rear of the blade 11. The other end 12*b* of pivot arm 12 extends between a top plate 16 of a bucket edge receiving assembly shown generally at 17, and an elongate locking bar 18 that is spaced from and fixed to the plate 16 by turned ends 18*a* and 18*b* of the locking bar that are welded to the plate 16. The spacing between the locking bar 18 and plate 16 is such that the end 12*b* of arm 12 can move along the plate 16, but is held against movement away from the plate 16 by locking bar 18.

A pair of spaced apart flanges 19 and 20 project from the rear of blade 11 below the connection of the end 12*a* or arm 12 to receive the end 21*a* of a tubular portion 21*b* of support arm 21 that extends rearwardly from the blade. A pin 22 inserted through the flange 19, and 21*a* of support arm 21 and flange 20 secures the arm 21 to the blade and provides a pivot shaft about which the support arm 21 can swing.

The support arm 21 has a lower plate 23 of the bucket edge receiving assembly 17 fixed to extend transversely thereacross the top plate 16.

A backing plate 24 extends from a top rear edge of the plate 16 downwardly to a location slightly below a lower edge of plate 23 and for the full length of the plates 16 and 23.

Support arm 21 includes an extension member 25 telescoped into the end of tubular member 21*b* and locked thereto by a pin 26 inserted through selected ones of aligned holes 27 in the tubular portion 21*b* and a corresponding hole in the extension member 25. The overall length of the support arm 21 can thus be changed in accordance with holes 27 selected and the extent to which the extension member 25 projects from the tubular portion 21*b*.

In use, the operator of a bucket vehicle moves the vehicle to approach the grader blade attachment 10 from the rear of blade 11. When a bucket 30 of the vehicle (not shown) is positioned over the support arm 21 at the side of the bucket edge receiving assembly opposite the blade, the bucket is tipped and moved forward to allow the lower forward edge of the bucket to slide on the support arm 21 and into the slot formed by top plate 16, lower plate 23 and backing plate 24. Thereafter, the bucket is manipulated to drop the rear of the bucket onto support arm 21. Spaced apart ears 31 and 32 are welded to the rear of the bucket 30 and each flares outwardly at its lower ends to provide guides as the ears move down past the upper end of a post 33 that extends transverse to the end of arm 21. When holes 34 in the ears are aligned with a hole 35 in the post 33, a pin 36 inserted through the aligned holes to lock the post to the ears. Thus, the front of the bucket is securely attached to the support arm 21, the slot formed by top plate 16, lower plate 23 and backing plate 24 while the rear of the bucket is secured to the support arm 21 by the pin 36 interlocking the ears 31 and 32 and the post 33.

The push angle of blade 11 can be readily changed with respect to the front edge of the bucket by turning the blade with respect to the pivot shaft. As the blade turns, the pivot arm 12 swings, as permitted, between the top plate 16 and the locking bar 18 of the bucket edge receiving assembly 17.

While the blade can be angled manually, as will be described, it is also possible to use hydraulic cylinders, coupled to the hydraulic system of the bucket vehicle to angle the blade and to hold it at a desired set angle.

As shown, hydraulic cylinders 40 and 41 each have their cylinder housings 40*a* and 41*a*, respectively, pivotally connected to the locking bar 18 and their cylinder rods 40*b* and 41*b* pivotally connected to flanges welded to the rear of the blade near the ends thereof. The usual hydraulic hoses 42 are connected to the cylinders and are adapted to be coupled to the hydraulic system of the vehicle in conventional fashion. Extension of one cylinder rod, concurrently with retraction of the other cylinder rod will angle the blade 11 in one direction with respect to the front edge of bucket 30 while an opposite actuation of the cylinder rods in conventional fashion will angle the blade in an opposite direction. The blade angle will then be maintained by the hydraulic cylinders.

If it is not desired to use hydraulics or if it is not possible to provide hydraulic controls to regulate angulation of the blade 11, manually adjustable angulation arms can be used. A typical arm is shown at 45 in FIG. 4. As shown, the arm includes a tubular member 46 and a telescoping member 47 adapted to slide into and out of one end of the tubular member 46. A bolt 48 inserted through a selected one of a plurality of holes 47*a* in the member 47 and a hole 46*a* in the member 46 has a nut 49 threaded thereon to lock the members 46 and 47 together. A pair of spaced ears 50 with aligned holes therethrough are used to pin members 46 to locking bar 18 in the same manner that cylinder housings 40*a* and 41*a* are attached thereto. A hole 51 in the end of each member 47 then permits the members 47 to be attached to the blade 11 in the same manner that cylinder arms 40*b* and 41*b* are attached.

A pair of arms 45 are used to replace the arms 40 and 41 when it is desired that the angulation of blade 11 be accomplished manually rather than hydraulically. In using the arms 45, the bolts 48 are removed, the blade 11 is turned to a desired angle and the bolts are repositioned to prevent further movement of the members 46 relative to the members 47. The blade 11 is thus locked against further turning about pivot pin 12*a*.

A curved, hardened skid plate 52 to the bottom of post 33 to provide a long wearing ground engaging member beneath the bucket. Similarly ground engaging curved skid plates 53 are provided to extend beneath the lowermost edge of blade 11 and to provide wear surfaces that will protect against damage to the blade during use. The plates 53 are each fixed to the lower end of a post 54 that is telescoped into a sleeve member 55, welded or otherwise affixed to the rear of the blade 11. The distance that the plates 53 are positioned beneath the lowermost edge of the blade 11 is set by telescoping the post 54 into or out of the sleeve members 55 and by a pin 56 inserted through a hole 57 each sleeve member 55 and through a corresponding one of a plurality of holes 58 in the post 54.

The grader blade of the assembly is easy to mount to a bucket of a vehicle and provides for angular blade adjustment and firm blade support whether or not the bucket vehicle can provide hydraulic power for use in pivoting the blade.

Although a preferred form of my invention has been herein disclosed it is understood that the present disclosure is by way of example and that variations are possible without departing from the subject matter coming within the scope of the following claims, which subject matter I regard as my invention.

I claim:

1. A grader blade attachment for a bucket vehicle comprising a scraper blade;

a support arm pivotally connected to the rear of the blade centrally thereof and extending rearwardly thereof to provide a sliding surface for a bucket;

a pivot arm having one end fixed to the rear of the blade centrally thereof; means guiding the other end of the immovably pivot arm to swing laterally while preventing vertical movement thereof during pivoting of the blade with respect to the pivot connection of the support arm to the blade;

channel means for receiving a lower leading edge of a bucket sliding on the support arm and coupling the leading edge of the bucket to the support arm;

means to couple the support arm to the rear of the bucket; and means to lock the angle of the blade with respect to the support arm.

2. A grader blade attachment as in claim 1, wherein the channel means for receiving the lower leading edge of the bucket comprises members fixed to and extending transversely of the support arm to form a slot in which the lower leading edge of the bucket extends.

3. A grader blade attachment as in claim 1 wherein the means to couple the support arm to the rear of the bucket includes a pair of spaced apart ears on the rear of the bucket, a post extending upwardly from an end of the support arm, holes through the ears and the post, and a pin adapted to extend through the holes in the ears and post to lock them together.

4. A grader blade attachment as in claim 3, wherein the ears are flared outwardly at their lower ends to provide guides for insertion of the post between the ears.

5. A grader blade attachment as in claim 4, wherein the means to lock the angle of the blade with respect to the support arm comprises at least one hydraulic cylinder interconnecting the blade off-center thereof with the support arm.

6. A grader blade attachment as in claim 5, wherein the means to lock the angle of the blade with respect to the support arm comprises a pair of hydraulic cylinders each interconnecting the blade at one side of center thereof to the support arm.

7. A grader blade attachment as in claim 4, wherein the means to lock the angle of the blade with respect to the support arm comprises at least one extensible and lockable arm interconnecting the blade at one side of center thereof to the support arm.

8. A grader blade attachment as in claim 1, further including skid plates beneath the support arm and the blade to provide ground engaging wear surfaces for the attachment.

9. A grader blade attachment as in claim 2 wherein the means to couple the support arm to the rear of the bucket includes a pair of spaced apart ears on the rear of the bucket, a post extending upwardly from an end of the support arm, holes through the ears and the post, and a pin adapted to extend through the holes in the ears and post to lock them together.

10. A grader blade attachment as in claim 9, wherein the ears are flared outwardly at their lower ends to provide guides for insertion of the post between the ears.

11. A grader blade attachment as in claim 10, wherein the means to lock the angle of the blade with respect to the support arm comprises at least one hydraulic cylinder interconnecting the blade off-center thereof with the support arm.

12. A grader blade attachment as in claim 11, wherein the means to lock the angle of the blade with respect to the support arm comprises a pair of hydraulic cylinders each interconnecting the blade at one side of center thereof to the support arm.

13. A grader blade attachment as in claim 12, wherein the means to lock the angle of the blade with respect to the support arm comprises at least one extensible and lockable arm interconnecting the blade at one side of center thereof to the support arm.

14. A grader blade attachment as in claim 13, further including skid plates beneath the support arm and the blade to provide ground engaging wear surfaces for the attachment.

* * * * *